US006238304B1

(12) United States Patent
Scolamiero et al.

(10) Patent No.: US 6,238,304 B1
(45) Date of Patent: May 29, 2001

(54) FLUID FILLED GOLF BALL CENTER WITH ENHANCED FLUID DYNAMIC PROPERTIES

(75) Inventors: Stephen K. Scolamiero, Bridgewater; Jeffrey L. Dalton, N. Dartmouth; Walter L. Reid, Jr., Mattapoisett, all of MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/448,151

(22) Filed: Nov. 24, 1999

Related U.S. Application Data

(60) Provisional application No. 60/111,807, filed on Dec. 11, 1998.

(51) Int. Cl.[7] ..... A63B 37/08
(52) U.S. Cl. ..... 473/354
(58) Field of Search ..... 473/354, 358, 473/367, 368, 375; 273/215, 231

(56) References Cited

U.S. PATENT DOCUMENTS

| | | | | |
|---|---|---|---|---|
| 698,516 | * | 4/1902 | Kempshall | 473/355 |
| 790,955 | * | 9/1905 | Davis | 473/355 |
| 1,366,930 | * | 2/1921 | Pearce | 473/354 |
| 5,683,312 | | 11/1997 | Boehm et al. | 473/354 |
| 5,820,485 | * | 10/1998 | Hwang | 473/376 |
| 5,984,807 | * | 11/1999 | Wai et al. | 473/376 |

* cited by examiner

*Primary Examiner*—Mark S. Graham
*Assistant Examiner*—Raenn Gordon
(74) *Attorney, Agent, or Firm*—Pennie & Edmonds LLP

(57) ABSTRACT

The present invention relates to controlling the spin of liquid or paste filled golf balls without requiring adjustment of the physical properties of the fluid or paste within the golf ball. Specifically, the inner surface of the liquid center shell is modified with a texture to alter frictional drag between the inner surface of the shell and the fluid to control spin rate and spin decay of the golf ball.

19 Claims, 3 Drawing Sheets

FLUID FILLED GOLF BALL CENTER WITH ENHANCED FLUID DYNAMIC PROPERTIES

This application claim benefit to provisional application 60/111,807 Dec. 11, 1998.

FIELD OF INVENTION

The present invention relates generally to liquid or paste filled golf balls. More particularly the invention relates to controlling the spin of liquid or paste filled golf balls. Still more particularly, the invention relates to a method of controlling the spin rate of liquid or paste filled golf balls without adjusting the physical properties of the fluid or paste within the golf ball.

BACKGROUND OF THE INVENTION

Generally golf balls are one of two types: solid or wound. One piece solid balls are typically made of polybutadiene, monomers, fillers and other materials. They are durable, easy to manufacture and are inexpensive. However, they do not provide ideal distance or spin, thus they are usually used as range or practice balls.

Two piece solid balls usually have a solid polymeric core and a cover. The core is typically made of a polybutadiene which is chemically cross-linked with zinc diacrylate and/or similar crosslinking agents. The core is then covered with a durable cover typically made with an elastomer or ionic copolymers such as SURLYN of E. I. DuPont de Nemours & Company. These balls are generally very durable and provide good distance because of their high initial velocity. However, they have a low spin rate due to their hardness and this results in their being difficult to control.

Wound balls are usually constructed with a solid or liquid filled center that is wound with yards of stretched elastic thread. A durable material such as SURLYN or a similar material, or a softer material such as balata or polyurethane is used to cover the wound core. Wound balls typically have better spin and feel characteristics than two piece balls. These balls are used by advanced players as they have more control over the ball's flight because the ball has a better spin and feel. However, these balls are structurally complex, and as such they are harder to manufacture. Wound golf balls are relatively more expensive than solid balls.

Many methods for manufacturing balls with liquid filled centers are disclosed in the prior art. For example, a liquid filled center can be made by vulcanizing two rubber hemispheres and applying an adhesive to the outer "lip" of the hemispheres and assembling the two hemispheres to create a sphere and subsequently vulcanizing the sphere. Liquid is injected into the sphere through use of a hypodermic needle and the resulting puncture hole is sealed with a patch material such as urethane isocyanate. As described in U.S. Pat. No. 4,443,322, the hemispheres can be submerged in a desired liquid before the two halves are joined and either vulcanizing the sphere while submerged or upon removal from the liquid.

Liquid-filled golf balls have certain fluid dynamic properties. The golf ball center fluid dynamics affect initial ball spin rate and rate of spin decay. These properties affect golf ball flight.

At impact between the club head and the ball, the tangential force transferred from the clubhead to the rigid structure of the ball, including the cover, windings and shell, will cause the rigid structure to spin. However, the inertial effects of the fluid mass will cause the spin of the fluid to lag behind that of the rigid structure of the ball. The force required to set the fluid in rotational motion is the frictional drag. Rotational kinetic energy from the spinning ball is transferred to the fluid by the drag force. This transfer of kinetic energy causes the spin rate of the rigid structure of the ball to drop or decay. Spin decay continues until the fluid and the ball are spinning at the same rotational speed.

The initial ball spin rate and the rate of spin decay affect the flight of the golf ball. Thus, if the fluid dynamic properties are altered to affect the initial spin rate and decay of the ball, the flight path of the ball can be altered. Therefore, golf ball performance can be improved by altering the fluid dynamic properties inside the shell of the golf ball.

The center shells of golf balls are designed and manufactured so that the inner surface is intentionally smooth. The only method presently available to modify the fluid dynamics within the center of the ball is to adjust the physical properties of the fluid within the center shell. Thus, the ability to alter the fluid dynamic properties within the center of the golf ball is limited by selection of a fluid. Accordingly, a ball is needed that will allow a golf ball designer to have greater control over the center fluid dynamics of a ball. Further, a ball is needed where fluid dynamic properties can be altered to affect initial spin rate and spin decay which will in turn affect overall ball performance by alteration of its flight path.

SUMMARY OF THE INVENTION

Broadly, the present invention is directed to a golf ball having a fluid filled center shell. More particularly, the present invention is directed towards adjustment of the frictional drag between the liquid center shell and the fluid within a golf ball. More particularly, the invention is directed to the use of a modified interior surface of the shell to alter frictional drag between the inner surface of the shell and the fluid to control spin rate and spin decay. Control of these will control lift of the ball along its flight trajectory as well as final spin when the ball impacts the ground, which are the keys to golf ball design and performance.

A liquid center shell according to the present invention is filled with a liquid. The shell has an inner surface with a texture. The texture alters the fluid dynamic properties of the shell of the golf ball. The inner surface of the shell can include different shaped protrusions or recesses. The protrusions or recesses can be of a variety of shapes including dimples, nubs, paddles or finger shaped projections. Furthermore, grooves may be used on the inner surface to form a texture. The size and number of these projections or grooves may be changed to achieve the desired alteration of the fluid dynamic properties of the core.

Another method of altering the inner surface is to have protrusions on the outer surface of the shell that are compressed thereby distorting the inner surface of the shell. Compression can be achieved by using a wound or solid ball construction. Still further, loose objects of varied shapes and sizes can be located within the liquid shell to alter the fluid dynamic properties to improve initial ball spin rate and decay.

Liquid filled wound golf balls employing a modified inner surface of the shell provide improved flight characteristics over balls with conventionally smooth inner shell surfaces. However, the liquid filled centers with a modified inner shell surface of the present invention are not limited for use in conventional wound balls. To the contrary, it is contemplated that the liquid filled centers of the present invention are useful in "solid" golf balls which comprise one or more layers of a solid material molded around a liquid filled core. Such as that disclosed in U.S. Pat. Nos. 5,683,346, and 5,150,906, which are incorporated herein by reference.

BRIEF DESCRIPTION OF DRAWINGS

FIG. 2(*a*) is a detail of the cross-sectional view of a shell of the present invention;

FIG. 3(*a*) is a detail of the cross-sectional view of a shell of the present invention;

DETAILED DESCRIPTION OF THE INVENTION

As used herein, the terms "points or compression points" refer to the compression scale or the compression scale based on the ATTI Engineering Compression Tester. This scale, which is well known to those working in this field, is used in determining the relative compression of a core or ball. Some artisans use the Reihle compression scale instead of the standard compression scale. Based on disclosure in U.S. Pat. No. 5,368,301, column 20, lines 55–53, it appears that Reihle compression values can be converted to compression values through the use of the following equation: compression value=160−Reihle compression value.

This invention is directed towards liquid filled center shells for use in golf balls. More particularly, the present invention is directed toward a center shell that allows modification of the fluid dynamic properties in the liquid-filled center by a means other than changing the type of fluid filling in the core. More particularly, this includes use of a modified inner surface of the shell.

Figure 1:
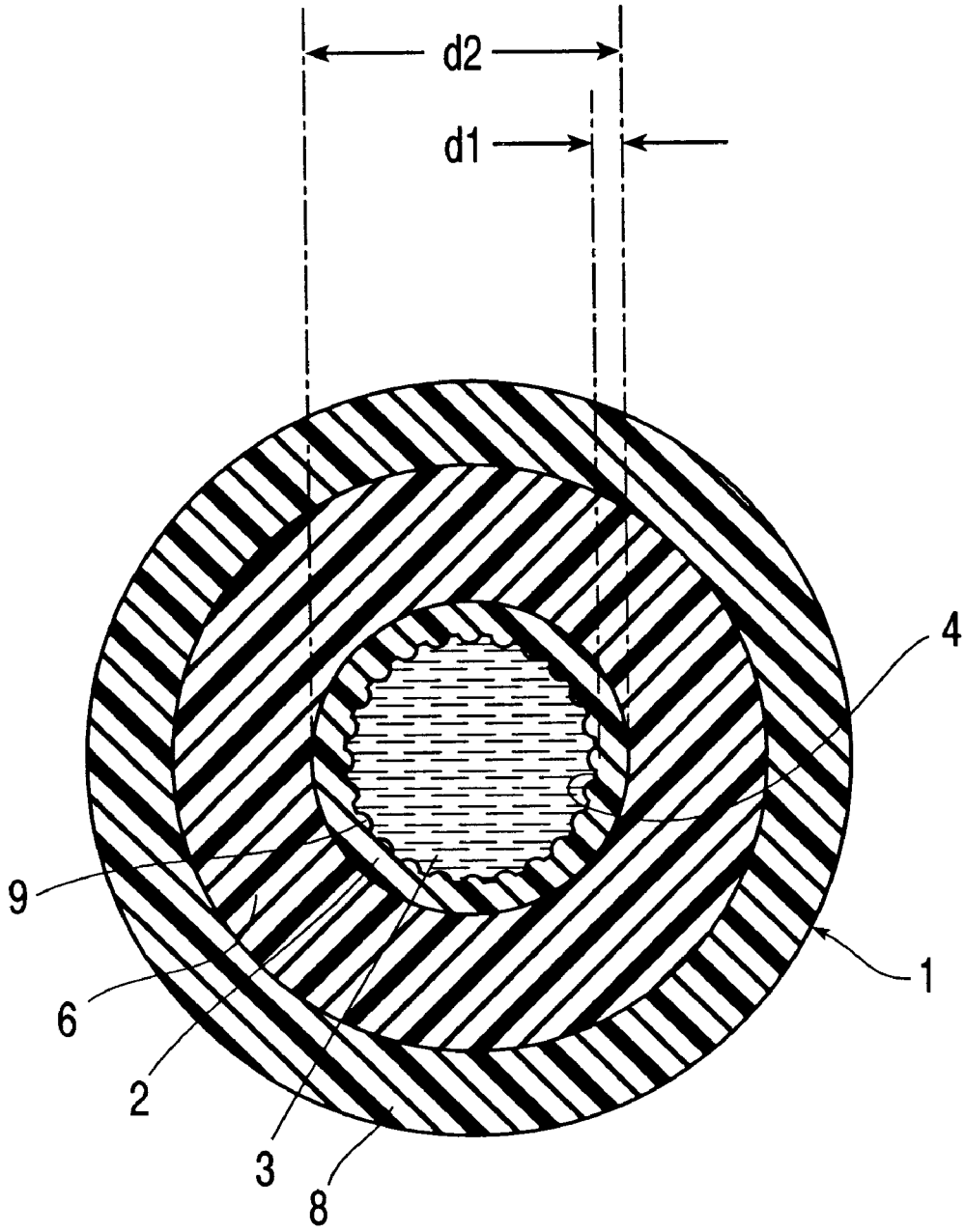
FIG. 1 is a cross-sectional view of a golf ball according to the present invention.
Figure 2:
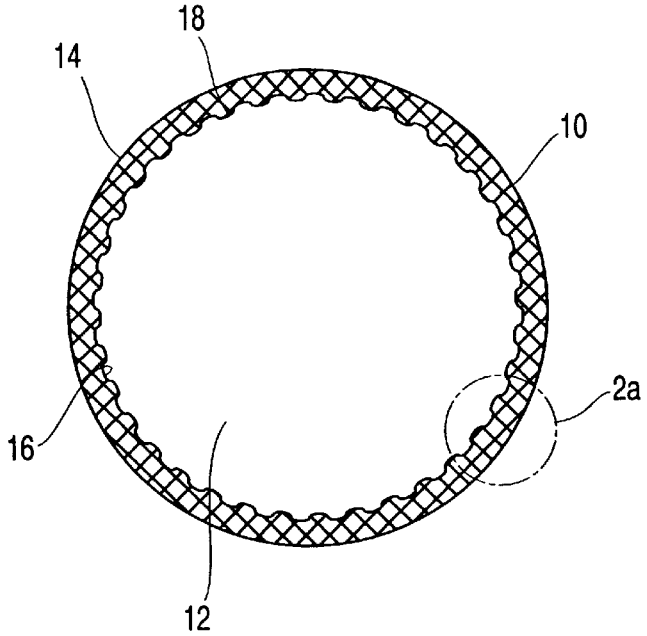
FIG. 2 is a cross-sectional view of a shell of the present invention.

Frictional drag between the shell and fluid is adjusted by modification of the inner surface next to the fluid. A golf ball 1 of the present invention is shown in FIG. 1. A shell 2 is filled with a fluid 3. The shell includes an inner surface 4. The shell 2 is covered with a wound layer 6 and a cover 8. The inner surface 4 of the shell 2 includes protrusions 9. The shell of the present invention will be discussed in more detail. As shown in FIG. 2, shell 10 is filled with a fluid 12. The shell 10 has an outer surface 14 and an inner surface 16. The outer surface 14 will be enclosed in a solid core in one or more layers and then covered or will be wound and then covered. The inner surface 16 of the shell 10 includes at least one dimple or recess 18. The particular dimples 18 shown are spherical shaped recesses. The size, shape, number and placement of these dimples 18 may be adjusted to modify the frictional drag within the shell 10. Use of this method does not require a golf ball designer to change the fluid to achieve different fluid dynamic properties. Thus, the method allows additional control over present techniques to adjust fluid dynamic properties.

Figure 3:
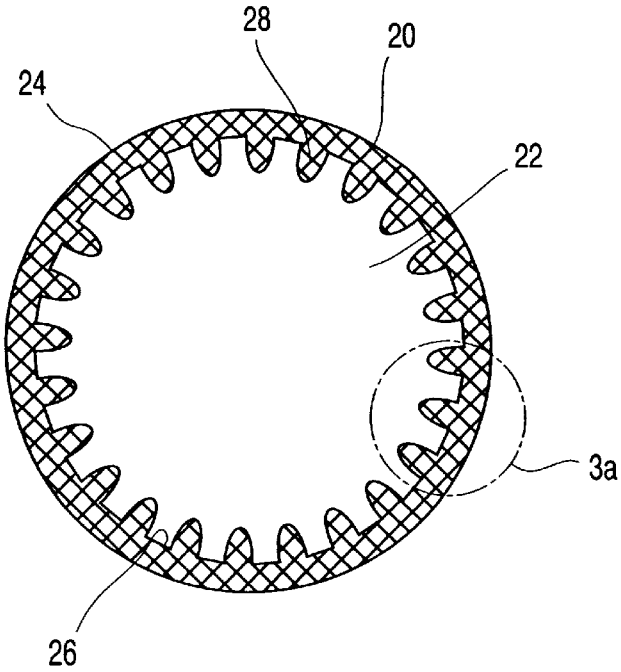
FIG. 3 is a cross-sectional view of a shell of another embodiment of the present invention.

FIG. 3 is another cross-sectional view of a different embodiment of the present invention. The shell 20 is shown filled with a fluid 22. The shell 20 includes an outer surface 24 and an inner surface 26. The outer surface 24 of the shell 20 will be enclosed by at least one layer and then covered or will be wound and then covered. The inner surface 26 of the shell 20 includes at least one paddle like protrusion 28. The size, shape, number and placement of these protrusions 28 may be modified to achieve the desired fluid dynamic affects.

The fluid filled golf ball center shell can be made of a variety of materials including thermoplastic compounds, thermoset, and metals. Virtually, any material that is formable into a hollow shell can be utilized with the present invention.

Many techniques may be used to modify the frictional drag of the fluid inside the liquid center shell. One technique, as described above, is to add a texture to the inner surface of the shell. The texture could be in the form of dimples, nubs, paddles or fingers extending into the center of the core of the golf ball or grooves cut or molded into the inner surface of the shell. Individual textures can themselves be modified by increasing or decreasing their size or depth, or altering their placement or number. Further, protrusions of varying sizes or shapes could be used on the inner surface of the shell.

Figure 4:
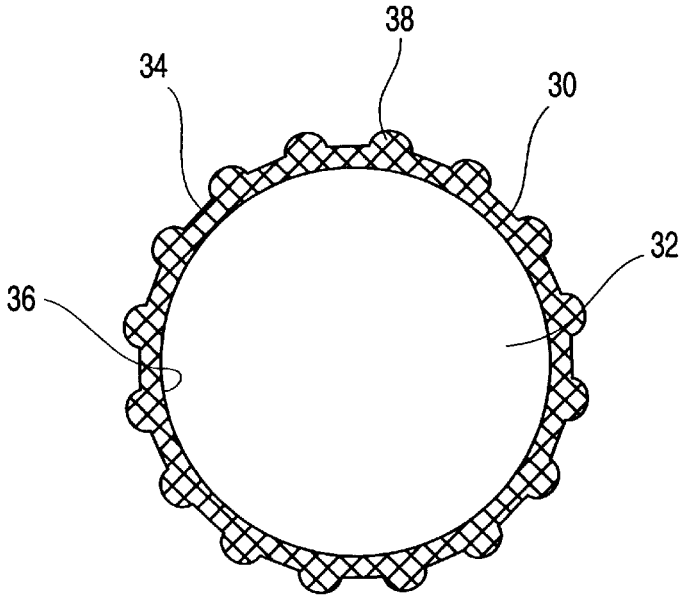
FIG. 4 is a cross-sectional view of a shell of another embodiment of the present invention.

FIG. 4 shows another technique to alter the frictional drag of the fluid inside the liquid center shell. A shell 30 is filled with a fluid 32. The shell 30 includes an outer surface 34 and an inner surface 36. A texture 38 is added to the outer surface 34 of the shell 30. This texture 38 includes use of protrusions on the outer surface 34 of the shell 30. The protrusions include use of shapes such as dimples, nubs, paddles, fingers or any number of other shapes. Once the shell 30 is compressed, the outer surface texture 38 of the shell 30 distorts and transfers to the inner surface 36 of the shell 30. Compression of the outer surface 34 of the shell 30 can be achieved by winding the ball to achieve a wound construction. Thus, the frictional drag of the fluid 32 inside the center of the ball is altered thereby allowing the golf ball designer to achieve desired improved flight characteristics. Further, as described above, the size, depth, number and placement of these protrusions could be varied to achieve the desired fluid dynamic properties and the improved flight characteristics of the ball. Differently shaped or sized protrusions could be used on the same shell.

Further, another method of altering the frictional drag of the fluid inside the shell is to place loose objects inside the shell. Different shaped objects could be used. Moreover, the size and number of the objects placed within the shell could be varied to achieve the desired frictional drag to cause the ball to have optimal flight characteristics. Such objects include squares, spheres or slender rods. Further, the objects could be made of a variety of materials including thermoplastics, thermoset, and metals.

It is contemplated that the present invention may use a number of different fluids in the liquid center shell. Solutions with different specific gravities may be used in conjunction with the present invention to achieve the desired results of initial spin rate and spin decay. Usually, solutions will be used with a specific gravity of about 1.16 to about 1.3.

The shell can be filled with a wide variety of fluids including water solutions, gels, foams and other fluid materials and combinations thereof. The fluid or liquid in the center can be varied to modify the performance parameters of the ball, such as the moment of inertia. Examples of suitable liquids include either solutions such as salt in water, corn syrup, salt in water and corn syrup, glycol and water or oils. The liquid can further include pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthenic oil.

The shell may be of any material suitable for forming a hollow shell. A large number of thermoplastic polymeric materials are contemplated as being useful in the core shells of the present invention. The thermoplastic materials may be employed alone or in blends. Suitable thermoplastic materials include but are not limited to rubber modified polyolefins, polymers formed with metallocene-catalysis (hereinafter "metallocene catalyzed polymers"), polyether-ester block copolymers, polyether-amide block copolymers, ionomers, thermoplastic based urethanes, copolymers of ethylene with butene and maleic anhydride, hydrogenated maleic anhydride, polyester polycaprolactone, polyester polyadipate, polytetramethylene glycol ether, thermoplastic elastomer, polypropylene, vinyl, chlorinated polyether, polybutylene terephalate, polymethylpentene, silicone, polyvinyl chloride, thermoplastic polyurethane, polycarbonate, polyurethane, polyamide, polybutylene, polyethylene and blends thereof.

Of the suitable materials described above, preferred thermoplastic materials include rubber modified polyolefins, metallocene-catalyzed polymers, polyether-amide block copolymers and polyether-ester block copolymers. Preferred rubber modified polyolefins are commercially available under the tradenames Vistaflex (Advanced Elastomer Systems), Kraton (Shell), Hifax (Montell), X1019-28 (M.A. Hanna), Sarlink (DSM), and Santoprene (Advanced Elastomer Systems). Preferred metallocene-catalyzed polymers are available from Dow Corporation under the tradenames Engage and Affinity. Preferred polyether-amide block copolymers are available under the tradename Pebax (Elf Atochem). Preferred polyether-ester block copolymers are commercially available from DuPont under the tradename Hytrel.

The thermoplastic liquid center shells of the present invention may also comprise a suitable filler material added in order to adjust the properties of the finished liquid center shell. For example, the specific gravity or density of the shell may be adjusted by the addition of a suitable material, such as barium sulfate, zinc oxide, calcium carbonate, titanium dioxide, carbon black, kaolin, magnesium aluminum silicate, silica, iron oxide, glass spheres, wollastonite, tungsten oxide, wolfranite, and metallic dust or paste. The filler material may be present in any amount that will adjust the specific gravity of the shell. Typically, the shell contains from about 5 percent by weight to about 70 percent by weight filler. More preferably, the filler material is present in an amount less than about 55 weight percent.

Additionally, the thermoplastic shells of the present invention may further comprise a suitable plasticizer or other material added in order to improve the processability and physical properties, such as the flow properties, of the thermoplastic materials. Conventional plasticizers known in the art are contemplated as being suitable for use in the present invention.

The shells of the present invention preferably have a wall thickness d1 of about 0.005 to about 0.5 inches. Preferably the wall thickness d1 is about 0.01 to about 0.2 inches, more preferably about 0.03 to about 0.12 inches.

The shells of the present invention have an overall diameter d2 of up to about 1.3 inches, preferably from about 0.05 inches to about 1.25 inches, more preferably about 1 inch to about 1.25 inches, and most preferably about 1.125 inches.

A number of the characteristics such as spin rate, initial velocity and "feel" of golf balls in which the present liquid filled center shells are incorporated are affected by the physical properties of both the shell material, shell diameter and thickness, as well as the liquid employed to fill the shell. Accordingly, parameters for a number of physical properties of the shell and liquid therein are considered to be important in optimizing the various play characteristics.

Moreover, the shells of the present invention preferably have a hardness of about 20 Shore A to 80 Shore D, and more preferably about 20 Shore D to 80 Shore D. Most preferably, the shells of the present invention have a hardness of about 30 to about 40 Shore D.

Further, the shells of the present invention preferably have a specific gravity of about 0.7 to about 3. More preferably the specific gravity of the shell is between about 1.25 and 2 and most preferably between about 1.5 and 2.

As shown in FIG. 2, the preferred method of the present invention is to have dimples 18 on the inner surface 16 of the shell 10. The shell 10 is formed by using injection molding. The mold cavity includes the texture for the inner surface of the shell 10. After molding the half spheres, they are bonded together by either hot plate bonding or spin welding. After the two halves are joined, the shell 10 is filled with fluid 12. This is done by injecting the fluid 12 under pressure through a hypodermic needle. The hole is then sealed by applying a molten material to the void.

Figure 3A:
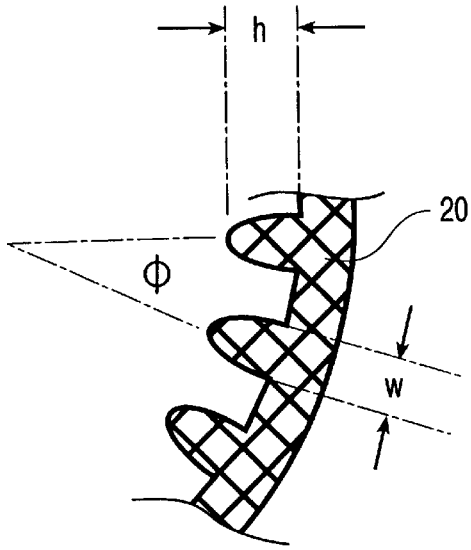

In another embodiment, finger or paddle-like protrusions are used. In this embodiment, the outside diameter of the core is approximately 1.125 inches and the inner diameter is approximately 1 inch. As shown in FIG. 3A, each finger like projection is preferably round and has a diameter or width w of about 0.01 to about 0.25 inches and a height h of about 0.01 to about 0.27 inches. More preferably, each finger has a width w of about 0.05 to about 0.25 inches and a height h of about 0.05 to about 0.25 inches. Most preferably, the finger has a width of about 0.06 to 0.1 inches and extends about 0.08 to 0.15 inches into the center of the core. The finger like projections are at an angle $\Phi$ about 12 to about 30 degrees from each other along the cross-sectional area of the circumference of the ball. More preferably, the finger like projections measure 16 to 25 degrees along the cross-sectional area.

Figure 2A:
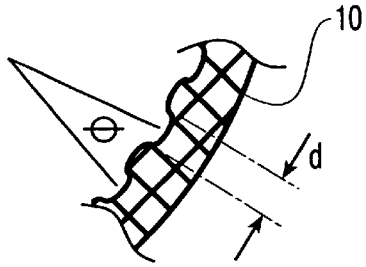

In another embodiment, the preferred shell 10 has an outer diameter of approximately 1.125 inches and an inner diameter of approximately 0.9 to 0.98, and more preferably an inner diameter of approximately 0.97 inches. As shown in FIG. 2A, the dimpled spheres each have a diameter d of about 0.09 to about 0.1 inches and more preferably about 0.095 inches, with each dimple spaced at an angle $\Theta$ about 8 to about 12 degrees along the cross-sectional area of the circumference of the ball, and more preferably about 10 degrees.

These and other aspects of the present invention may be more fully understood with reference to the following non-limiting examples, which are merely illustrative of the preferred embodiment of the present invention golf ball construction, and are not to be construed as limiting the invention, the scope of which is defined by the appended claims.

EXAMPLE 1

Figure 5:
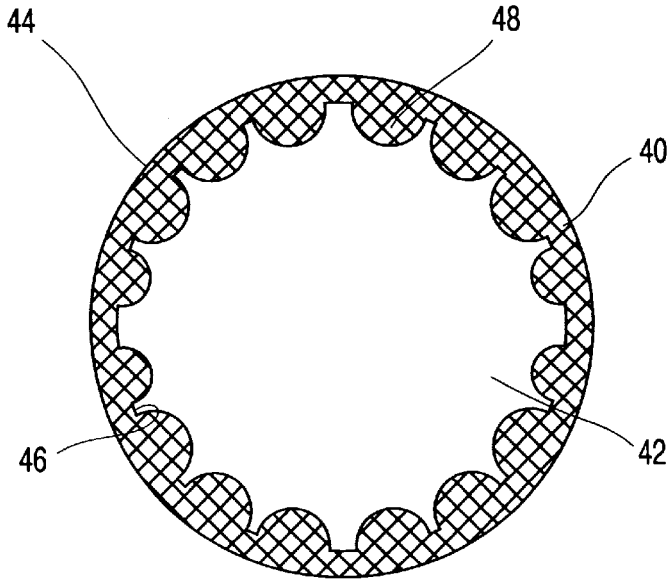
FIG. 5 is a cross-sectional view of a shell of another embodiment of the present invention.

A golf ball according to the present invention was made. As shown in FIG. 5, a liquid center shell 40 included an outer surface 44 and an inner surface 46. The shell 40 was filled with a fluid 42. Further, the inner surface included nubs 48. The shell 40 had a thickness of approximately 0.065 inches and an outside diameter of approximately 1.13 inches. The inner surface 46 of the shell 40 had fifty (50)

nubs 48 equally spaced per hemisphere. The nubs 48 measured approximately 0.125 inches in diameter, with a height of approximately 0.0625 inches. The distance between the center of two nubs 48 measured 0.15 inches. The shell 40 was made of PEBAX 3533 with a specific gravity of 1.8. The fluid 42 used in the ball had a specific gravity of 1.3. The outer surface 44 of the shell 40 was wound with a 0.02 inch thread. The cover was made of a Urethane Elastomer. The compression using ATTI Compression Tester, was 100 points. The finished ball weight was 45.69 g and the velocity measured at 252.39 ft/sec. Tests were performed using a driver, 8 iron and ½ wedge using a true temper. The results are listed in Tables 1 through 3 and can be compared with the results for the ball of Example 2 and an unmodified ball with a smooth inner core surface.

EXAMPLE 2

A ball according to the present invention was made. This shell with an inner textured surface was also formed as shown in FIG. 5 and described above. The shell was made of PEBAX 3533 with a specific gravity of 2. The fluid within the shell had a specific gravity of 1.13. The shell was wound with 0.02 inch thread, and the cover was made of a Urethane Elastomer. The ATTI compression of the ball was 101 and the finished ball weighed 46.35 g. The ball had a velocity of 252.40 ft/sec. Tests were performed using a driver, 8 iron and ½ wedge. The results are listed in Tables 1 through 3 and can be compared with the ball in Example 1 and an unmodified ball.

TABLE 1

| DRIVER | |
|---|---|
| BALL TYPE | Spin rpm |
| Example 1 | 3707 |
| Example 2 | 3701 |
| Untextured Core (Control) | 3810 |

TABLE 2

| 8 IRON | |
|---|---|
| BALL TYPE | Spin rpm |
| Example 1 | 7858 |
| Bxample 2 | 7885 |
| Untextured Core (Control) | 8177 |

TABLE 3

| ½ WEDGE | |
|---|---|
| BALL TYPE | Spin rpm |
| Example 1 | 6987 |
| Example 2 | 7032 |
| Untextured Core (Control) | 7132 |

As is evident from the testing results, the golf balls constructed according to the present invention had lower spin rates. Specifically, the protrusions increased frictional drag which resulted in a spin rate dramatically decreased in comparison to a run-textured ball. The Driver exhibited spin rates decreased by 103 and 109 rpm, while the 8 Iron spin rates were decreased by 319 and 292 rpm, and the ½ Wedge spin rates decreased by 145 and 100 rpm. Thus, the present invention results in lower spin rates for golf balls.

While it is apparent that the illustrative embodiments of the invention herein disclosed fulfills the objectives stated above, it will be appreciated that numerous modifications and other embodiments may be devised by those skilled in the art. For example cubed shaped protrusions could be placed on the inside surface of the liquid center shell. Therefore, it will be understood that the appended claims are intended to cover all such modifications and embodiments which come within the spirit and scope of the present invention.

What is claimed is:

1. A golf ball comprising:

a liquid filled core, the liquid filled core comprising an outer shell with an inner and an outer surface; and a texture included on the inner surface of the shell wherein the texture is a plurality of protrusions evenly spaced on the inner surface of the shell.

2. The golf ball of claim 1 wherein the protrustions are paddle-like projections.

3. The golf ball of claim 2 wherein the protrusions have a height of about 0.01 to 0.27 inches and a width of about 0.01 to 0.25 inches.

4. The golf ball of claim 2 wherein the protrusions have a height of about 0.05 to 0.27 inches and a width of about 0.05 to 0.25 inches.

5. The golf ball of claim 3 wherein the protrusions are spaced at about 12 to 30 degrees along the cross-sectional area of the circumference of the shell.

6. The golf ball of claim 1, wherein the shell has a specific gravity of about 0.7 to 3.0.

7. The golf ball of claim 1, wherein the shell has a diameter of less than 1.3 inches.

8. The golf ball of claim 1, wherein the shell has a wall thickness of about 0.005 to 0.5 inches.

9. The golf ball of claim 1, wherein the shell has a wall thickness of about 0.03 to 0.12 inches.

10. The golf ball of claim 1, wherein the shell includes a filler.

11. The golf ball of claim 10, wherein the filler is about 5% to 70% by weight of the shell.

12. The golf ball of claim 1, wherein the liquid has a specific gravity of about 1.16 to 1.3.

13. The golf ball of claim 1, further comprising a cover and a layer disposed between the cover and the shell.

14. The golf ball of claim 13, wherein the cover has a Shore D hardness of about 20 to 80.

15. A golf ball comprising:

a liquid filled core;

the liquid filled core comprising an outer shell with an inner and an outer surface; and a texture included on the inner surface of the shell wherein the texture is a plurality of recesses evenly spaced on the inner surface of the shell.

16. The golf ball of claim 15 wherein the recesses are spherical dimples.

17. The golf ball of claim 16 wherein the recesses have a diameter of about 0.01 to 0.1 inches.

18. The golf ball of claim 16 wherein the recesses have a diameter of about 0.09 to 0.1 inches.

19. The golf ball of claim 17 wherein the recesses are spaced at about 8 to 12 degrees along the cross-sectional area of the circumference of the shell.

* * * * *